US005472286A

United States Patent [19]

Uemura et al.

[11] Patent Number: 5,472,286

[45] Date of Patent: Dec. 5, 1995

[54] INK RIBBON CASSETTE

[75] Inventors: Hisashi Uemura; Masaru Sugie; Masayuki Kubota; Junji Akutsu; Minako Sato, all of Inagi, Japan

[73] Assignee: Fujitsu Isotec Limited, Tokyo, Japan

[21] Appl. No.: 276,404

[22] Filed: Jul. 18, 1994

[30] Foreign Application Priority Data

Jul. 19, 1993 [JP] Japan ..... 5-178245

[51] Int. Cl.[6] ..... B41J 33/10

[52] U.S. Cl. ..... 400/196.1; 400/235.1

[58] Field of Search ..... 400/194, 195, 400/196, 196.1, 207, 208, 235, 235.1, 54

[56] References Cited

U.S. PATENT DOCUMENTS

| | | | |
|---|---|---|---|
| 4,213,715 | 7/1980 | Haftmann et al. | 400/195 |
| 4,273,453 | 6/1981 | Haftmann | 400/195 |
| 4,293,234 | 10/1981 | Yonkers et al. | 400/235.1 |
| 4,397,574 | 8/1983 | Wojdyla . | |
| 4,614,448 | 9/1986 | Suzaki et al. . | |
| 4,900,170 | 2/1990 | Beck et al. | 400/235.1 |
| 4,988,224 | 1/1991 | Furrow et al. | 400/195 |
| 5,209,586 | 5/1993 | Furrow et al. | 400/196.1 |

FOREIGN PATENT DOCUMENTS

| | | | |
|---|---|---|---|
| 0149964 | 7/1985 | European Pat. Off. . | |
| 104383 | 6/1985 | Japan | 400/235.1 |
| 60-171357 | 11/1985 | Japan . | |
| 62-55182 | 3/1987 | Japan | 400/235.1 |
| 62-128850 | 8/1987 | Japan . | |
| 63-51756 | 4/1988 | Japan . | |
| 554490 | 8/1993 | Japan | 400/196.1 |

*Primary Examiner*—Ren Yan

*Attorney, Agent, or Firm*—Nikaido, Marmelstein, Murray & Oram

[57] ABSTRACT

One of a ribbon feed roller (32) and a pressure roller (34) for making an endless ink ribbon (30) run is displaceable relative to the other roller thereof for facilitation of replacement of the ink ribbon, and can be locked at a withdrawn position thereof. In a state where one roller is locked at the withdrawn position, mounting of the ink ribbon cassette on a printer is obstructed. Also, a running direction and an orientation of the endless ink ribbon are defined so that damage to the bonded portion of the endless ink ribbon is delayed as much as possible.

11 Claims, 10 Drawing Sheets

INK RIBBON CASSETTE

BACKGROUND OF THE INVENTION

1. Field of the Invention

The present invention relates to an ink ribbon cassette for an impact printer such as a serial wire-dot printer.

2. Description of the Related Art

In recent years, in contrast to the fact that more compact ink ribbon cassettes are required because the impact printers are becoming more compact, a prolongation of the service life of the ink ribbon cassette is also demanded. To respond to such a requirement, for example, an ink ribbon cassette disclosed in Japanese Unexamined Utility Model Publication No. 62-128850 and in Japanese Unexamined Utility Model Publication No. 63-51756 uses an endless ink ribbon. In this type of ink ribbon cassette, an ink ribbon storage unit, which stores the ink ribbon in a zigzag manner, is provided and an ink ribbon passage going from a first side of this ink ribbon storage unit toward a second side thereof is formed. Where the ink ribbon is made to run from the first side of the ink ribbon storage unit through the ink ribbon passage to the second side thereof, a ribbon feed roller, with a pressure roller elastically pressed against the ribbon feed roller, is provided on the second side of the ink ribbon storage unit. In particular, the ribbon feed roller is arranged in such a manner that the ink ribbon is wound around the ribbon feed roller over substantially a half circumference thereof, while the pressure roller is elastically pressed against the ink ribbon. When such an ink ribbon cassette is mounted on a carriage of the printer, a drive shaft projected from the carriage is received and engaged in a hole of the ribbon feed roller. During the printing operation of the printer, the ribbon feed roller is driven to rotate in the predetermined direction by the drive shaft, whereby the ink ribbon is sequentially drawn from one side of the ink ribbon storage unit and subsequently passes through the ink ribbon passage and then is drawn to the other side of the ink ribbon storage unit and stored again there. With the arrangement as mentioned above, the ink ribbon can be used over a long period until the service life thereof is ended, that is, until the ink ribbon is physically broken.

Moreover, to save natural resource, it is also a general practice to make the replacement of the ink ribbon in the ink ribbon cassette possible. In this case, the ink ribbon cassette per se can be used semipermanently. Such an ink ribbon cassette with a replaceable ink ribbon is constituted so that, at the time of replacement of the ink ribbon, the pressure roller is locked at a withdrawn position at a distance from the ribbon feed roller, whereby the replacement of the ink ribbon is easily carried out by the user.

However, the user is liable to make a mistake and may mount the ink ribbon cassette on the printer while the pressure roller is locked at the withdrawn position after the replacement of the ink ribbon. At this time, the ink ribbon cannot run through the ink ribbon passage, and therefore during the operation of the printer, the printing impact is concentrated at only a specific portion of the ink ribbon. Even if the user becomes aware of such an error and makes adjustments to allow the ink ribbon to run, such a portion is weakened in comparison with the other portions, and thus a problem that the service life of the ink ribbon is shortened.

On the other hand, an endless ink ribbon is formed by bonding the two ends of a long length of an ink ribbon by ultrasonic bonding. When this bonded portion is subjected to the printing impact, the bonded portion is liable to be damaged earlier than the other portions. This tendency is more conspicuous as the printing speed increases. Accordingly, to respond to the demand for high speed printing in recent years, it has been demanded to reduce the damage to such a bonded portion as much as possible.

SUMMARY OF THE INVENTION

Accordingly, an object of the present invention is to provide an ink ribbon cassette using an endless ink ribbon, constituted such that the endless ink ribbon cannot be mounted on the printer in such a state that the endless ink ribbon cannot be moved at the time of replacement of the ink ribbon.

Also, another object of the present invention is to provide an ink ribbon cassette using an endless ink ribbon, wherein a running direction of the endless ink ribbon and an orientation thereof are defined so that the printing impact to the bonded portion of the endless ink ribbon can be reduced as much as possible.

According to a first aspect of the present invention, there is provided an ink ribbon cassette comprising: an ink ribbon storage means for storing an endless ink ribbon; an ink ribbon passage means extended from a first side of the ink ribbon storage means to a second side thereof; a ribbon feed roller and a pressure roller provided on the second side of the ink ribbon storage means for making the ink ribbon run from the first side of the ink ribbon storage means to the second side thereof through the ink ribbon passage, one of the ribbon feed roller and the pressure roller being displaceable between a pressing position at which the one roller is elastically pressed against the other roller and a withdrawn position retracted from the pressing position; and a locking means for releasably locking the one roller at the withdrawn position, wherein either roller of the ribbon feed roller or pressure roller which is made displaceable is constituted as a drive roller, and the other of the same is constituted as a driven roller. In such an ink ribbon cassette, the characteristic feature resides in that either roller of the ribbon feed roller or pressure roller, which is made displaceable, is constituted as a drive roller and the other thereof is constituted as a driven roller. In this ink ribbon cassette, preferably, a shaft element of the drive roller has an engagement hole formed therein for receiving a drive shaft provided in a printer, whereby reception of the drive shaft into the engagement hole of the shaft element of the drive roller is obstructed at the time of mounting of the ink ribbon cassette on the printer while placing the drive roller at the withdrawn position as it is. On the other hand, in the ink ribbon cassette, it is also possible even if either roller of the ribbon feed roller or the pressure roller which is made displaceable is rotatably supported by a movable support member. In this case, the movable support member is provided with at least one plate spring element having a claw element; the claw element of the plate spring element is engaged with a hole formed in the side wall of the ink ribbon storage means when the displaceable roller is placed at the withdrawn position thereof, whereby the displaceable roller is locked at the withdrawn position thereof; the plate spring element has an extension portion formed therewith, which is projected from the side wall of the ink ribbon storage means to the outside when the claw element is engaged with the hole; and the extension portion interferes with a structure of the printer at the time of mounting of the ink ribbon cassette on the printer.

Also, according to the second aspect of the present invention, there is provided an ink ribbon cassette comprising: an ink ribbon storage means for storing an endless ink ribbon; an ink ribbon passage means extended from a first side of the ink ribbon storage means to the second side thereof; and a ribbon feed roller and a pressure roller provided on the second side of the ink ribbon storage means for making the ink ribbon run from the first side of the ink ribbon storage means to the second side thereof through the ink ribbon passage, wherein the endless ink ribbon is formed in such a manner that end portions of a long length of an ink ribbon made of a fabric of a synthetic resin fiber are superimposed and bonded by ultrasonic bonding; one side part of the bonded portion of the endless ink ribbon is molten and resinified as a solid part, and the other side part thereof is brought to a semi-molten state as a semi-solid part; and, at a time of mounting of the ink ribbon cassette on a printer, a running direction of the endless ink ribbon and an orientation thereof are defined so as to avoid a passing mode wherein an printing head of the printer relatively passes the resinified solid part of the bonded portion of the endless ink ribbon in an non-opposed direction, as defined hereinafter.

BRIEF DESCRIPTION OF THE DRAWINGS

Other objects and advantages of the present invention will be better understood from the following description, with reference to the accompanying drawings, in which.

DESCRIPTION OF THE PREFERRED EMBODIMENTS

Referring to FIG. 1 through FIG. 7, a preferred embodiment of the ink ribbon cassette according to the present invention is shown, and this ink ribbon cassette is provided with a casing 10 and a cover 12, which are formed of a suitable synthetic resin material such as an ABS resin. The upper side of the casing 10 is open, and the cover 12 is detachably attached to the casing 10 so as to cover the open portion thereof. As is apparent from FIG. 1 and FIG. 2, the casing 10 includes a rectangular part 10*a*, a first arm 10*b* projected from a first side of the rectangular part 10*a*, and a second arm 10*c* projected from a second side of the rectangular part 10*b* in the same direction. Also, the cover 12 is constituted to be substantially the same shape as the shape of such a casing 10. Namely, the cover 12 includes a rectangular part 12*a*, and first and second arms 12*b* and 12*c* projected from the corresponding sides of the rectangular part 12*a*.

Figure 1:
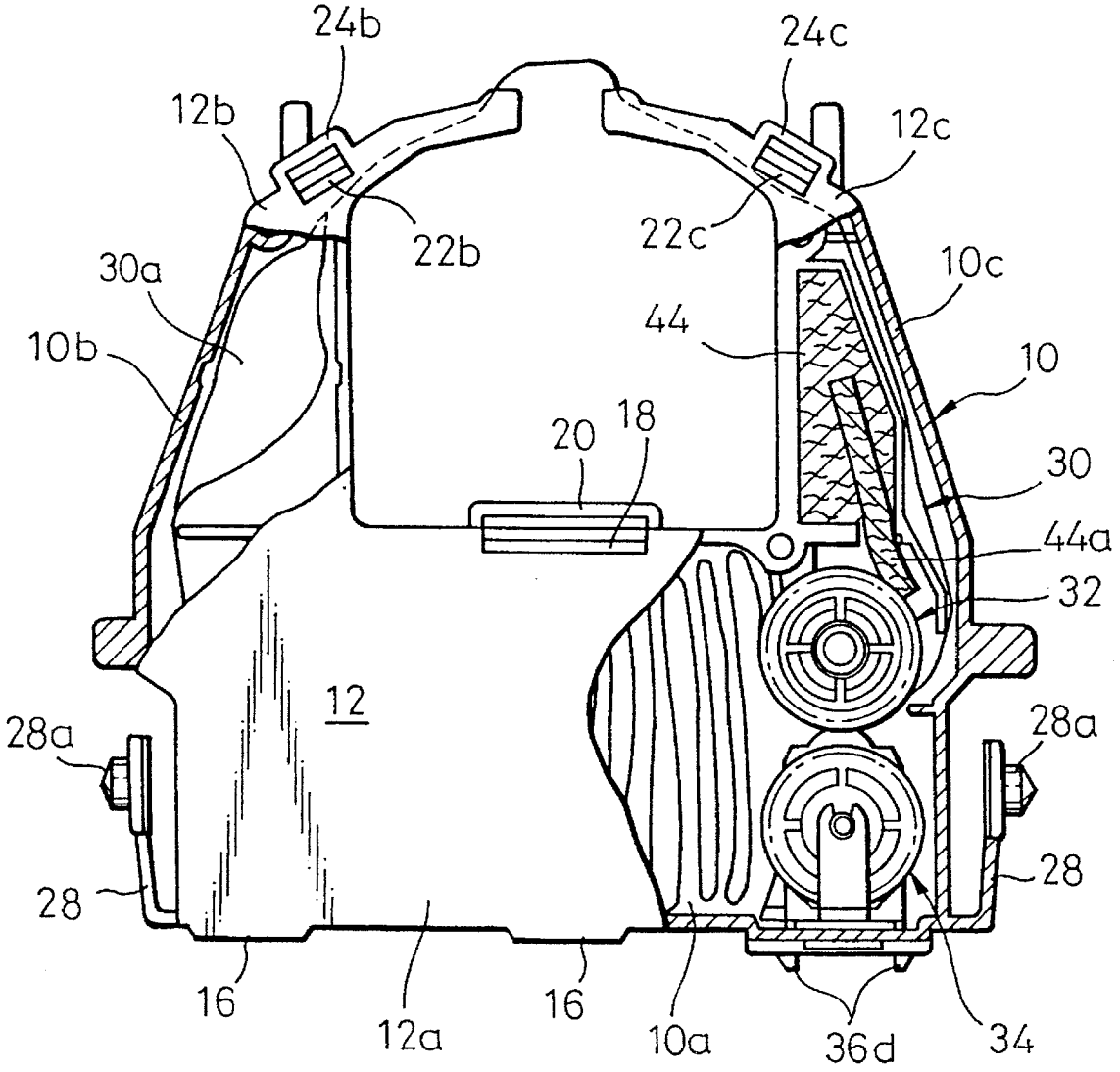
FIG. 1 is a partially cutaway plan view of an ink ribbon cassette according to the present invention, showing the same in a state where a pressure roller is locked at a withdrawn position.
Figure 3:
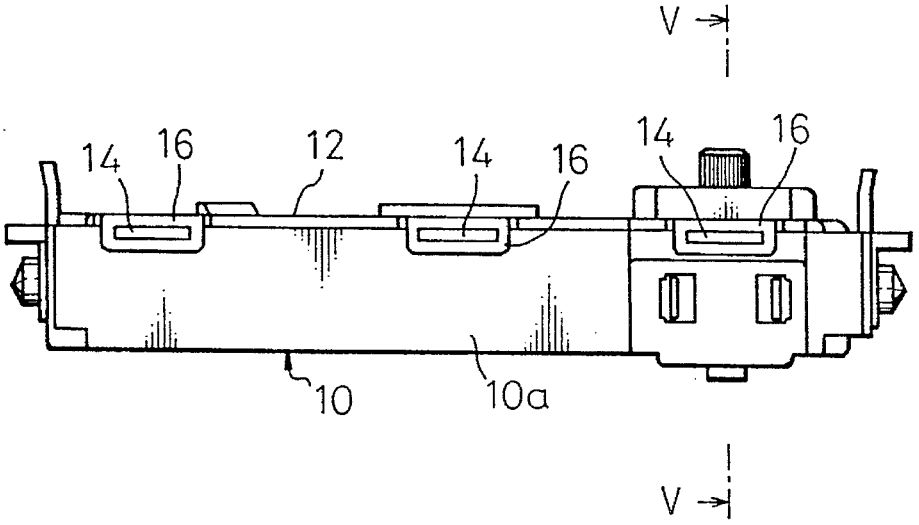
FIG. 3 is a rear view of the ink ribbon cassette of FIG. 1.
Figure 4:
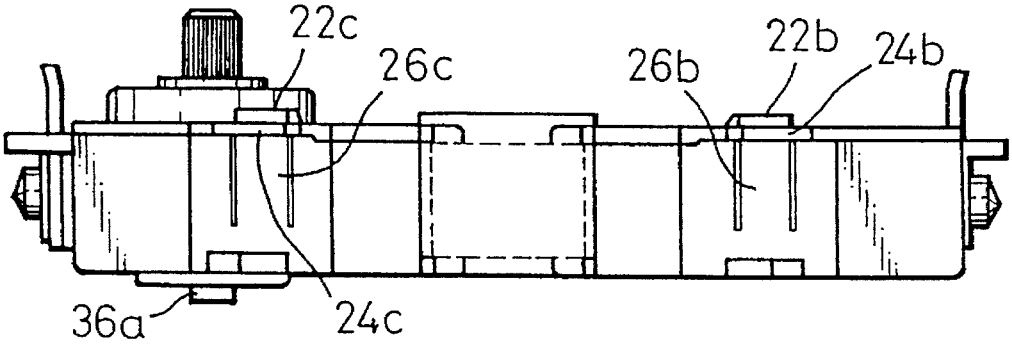
FIG. 4 is a front view of the ink ribbon cassette of FIG. 1.

As best illustrated in FIG. 3, to detachably attach the cover 12 to the casing 10, three projections 14 are integrally formed along the top edge of the rear side wall of the rectangular part 10*a* of the casing 10, while three tongue pieces 16 are integrally projected from the rear edge of the rectangular part 12*a* of the cover 12 along the rear side wall of the rectangular part 10*a* of the casing 10. Each of the projections 14 is fitted in a slot hole formed in the corresponding tongue piece 16 thereof. Also, as shown in FIG. 1, a projection 18 is formed integrally on the front side wall of the rectangular part 10*a* of the casing 10 along the top edge thereof, while a tongue piece 20 is integrally projected from the front edge of the rectangular part 12*a* of the cover 12, and the projection 18 are fitted in slot holes formed in the tongue piece 20. Further, as shown in FIG. 1 and FIG. 4, projections 22*b* and 22*c* are formed from the outward side wall on the front side of the first and second arms 10*b* and 10*c* of the casing 10, respectively, while tongue pieces 24*b* and 24*c* are integrally projected from the front edges of the first and second arms 12*b* and 12*c* of the cover 12, respectively, and the projections 22b and 22c are fitted in slot holes formed in the tongue pieces 24b and 24c. As is apparent from FIG. 4, a pair of slits are formed in each of the outward side walls on the front side of the first and second arms 10b and 10c of the casing 10 so as to form plate spring elements 26b and 26c, and top edges of the respective plate spring elements 26b and 26c form the projections 22b and 22c. Due to such an elastic deformation of plate spring elements 26b and 26c, the attachment and detachment of the cover 12 with respect to the casing 10 can be relatively easily carried out.

Figure 2:
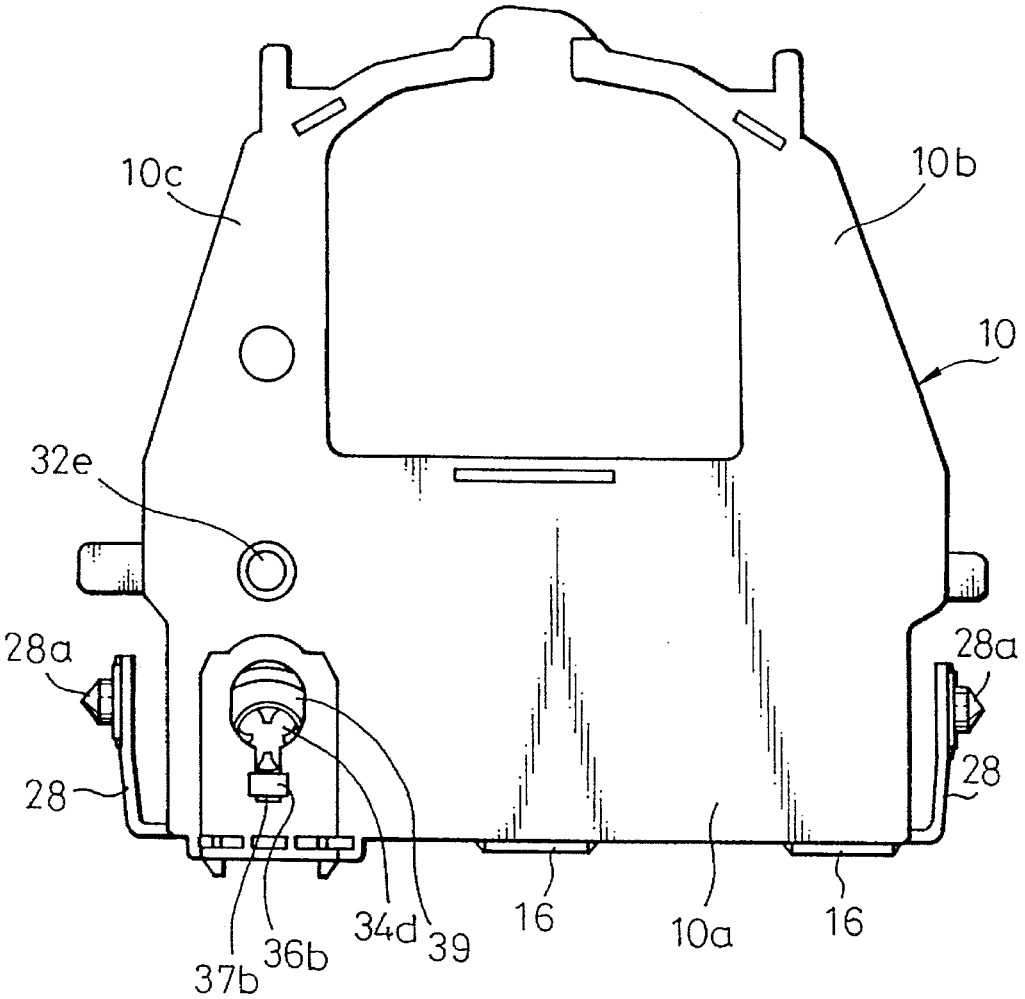
FIG. 2 is a bottom view of the ink ribbon cassette of FIG. 1.

As obvious from FIG. 1 and FIG. 2, the rectangular part 10a of the casing 10 is provided with a pair of plate spring members 28 which are integrally projected from the two ends of the rear side wall thereof and extended substantially in parallel to the two end walls of the rectangular part 10a. An end shaft 28a is formed on the outside of the tip end of each plate spring member 28. In the present embodiment, the ink ribbon cassette is mounted on the carriage of a serial wire-dot printer (not shown). At the time of mounting, the end shafts 28a of the plate spring members 28 are attached to the positioning hole provided in the carriage of the printer. Note that, when the ink ribbon cassette is mounted on the carriage, the wire-dot printing head is located in a space surrounded by the first and second arms 10b and 10c of the casing 10.

As shown in FIG. 1, the endless ink ribbon 30 is accommodated in the casing 10. The rectangular part 10a of the casing 10 acts as an ink ribbon storage unit for storing the endless ink ribbon 30 in a zigzag manner, and the first and second arms 10b and 10c of the casing 10 form the ink ribbon passage by cooperating with each other. A space at which the ink ribbon is exposed is provided between the tip ends of the first and second arms 10b and 10c, and the ink ribbon is made to run across the printing surface of the wire-dot printing head at that exposed portion.

In the present embodiment, the endless ink ribbon 30 is formed by bonding the two ends of a long length of an ink ribbon by ultrasonic bonding. One of the two ends of the ink ribbon is twisted exactly one half turn with respect to the other thereof, and thus the endless ink ribbon 30 forms a so-called Mobius strip. Accordingly, a twist part 30a is produced at the endless ink ribbon 30 only at one position, and that twist part is accommodated inside the first arm 10b of the casing 10 as shown in FIG. 1 and restrained there. Note that, by forming the endless ink ribbon 30 as a Mobius strip, the printing impact with respect to the endless ink ribbon 30 is dispersed in the width direction thereof, and thus the service life of the endless ink ribbon 30 can be prolonged.

Figure 5:
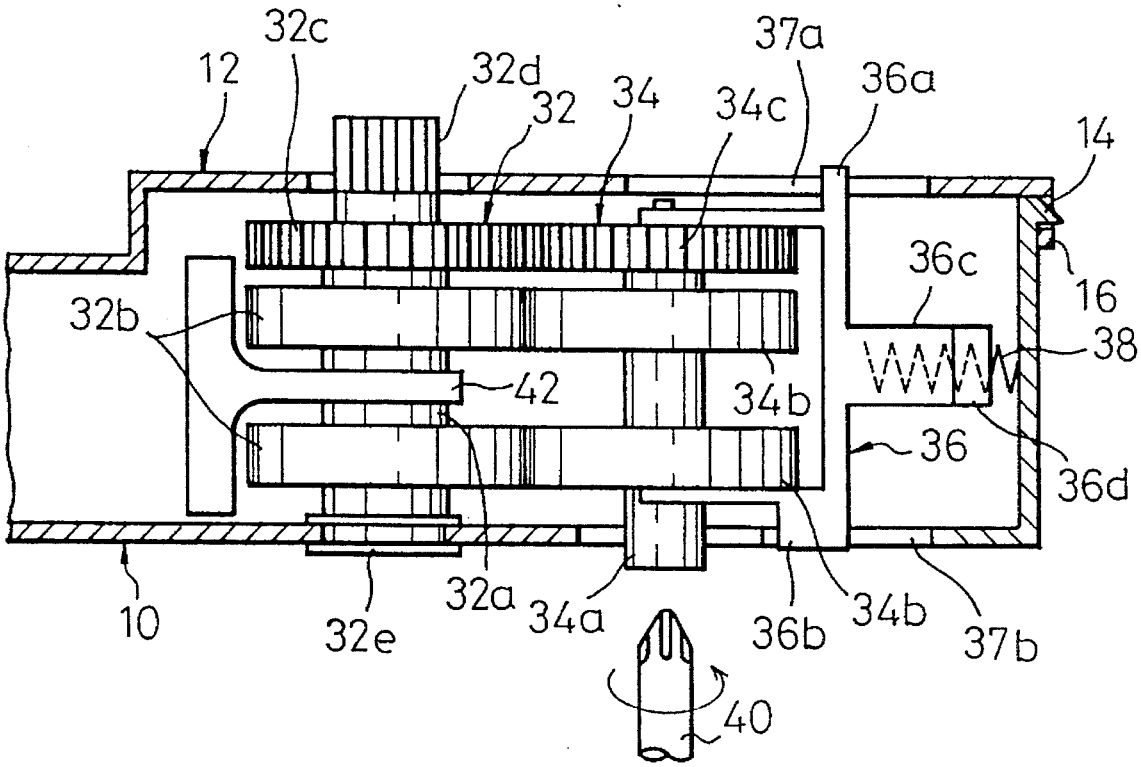
FIG. 5 is a partially enlarged cross-sectional view taken along a line V—V in FIG. 3.
Figure 6:
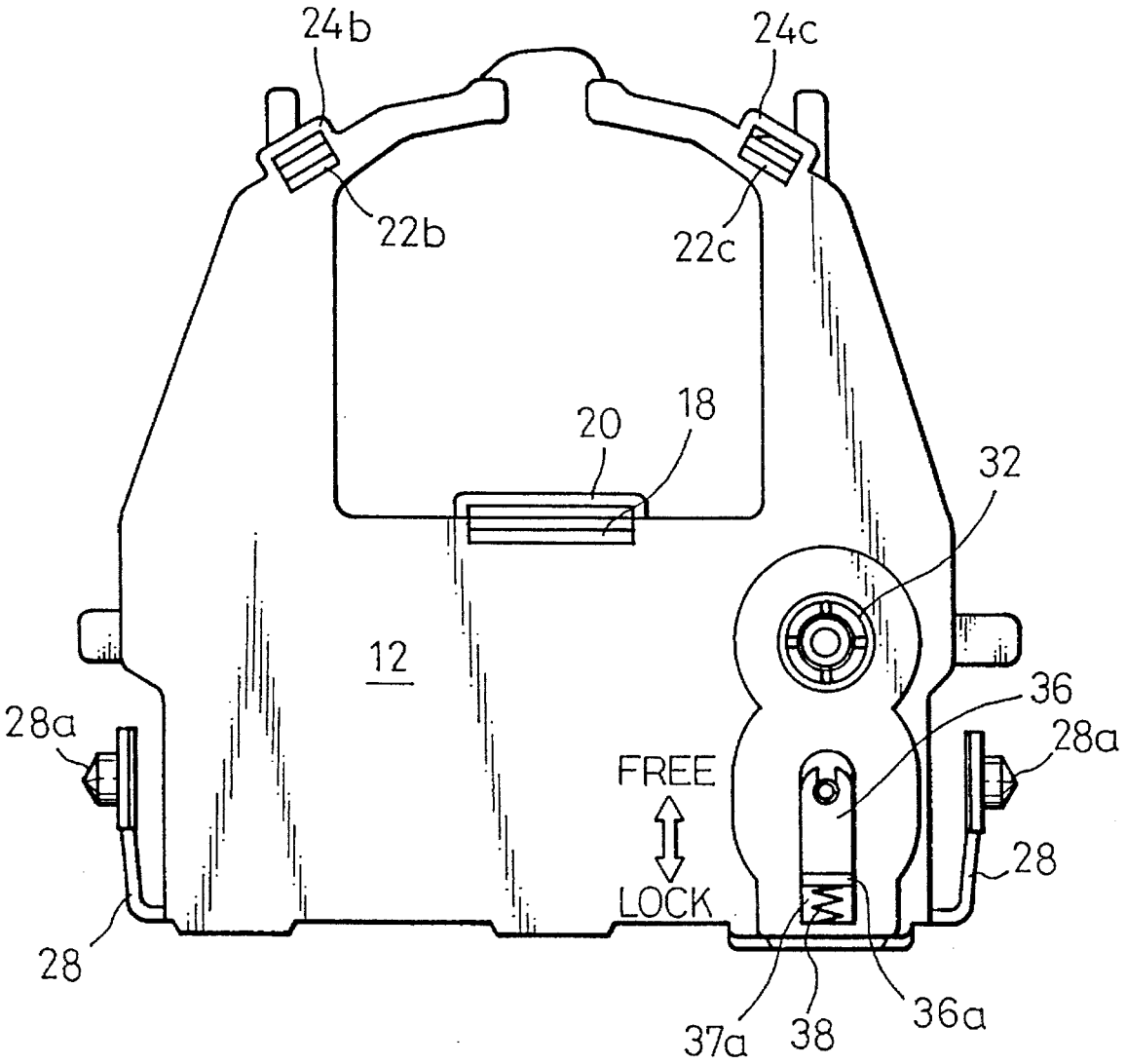
FIG. 6 is a plan view similar to FIG. 1, but showing the pressure roller at the pressing position with respect to the ribbon feed roller.
Figure 7:
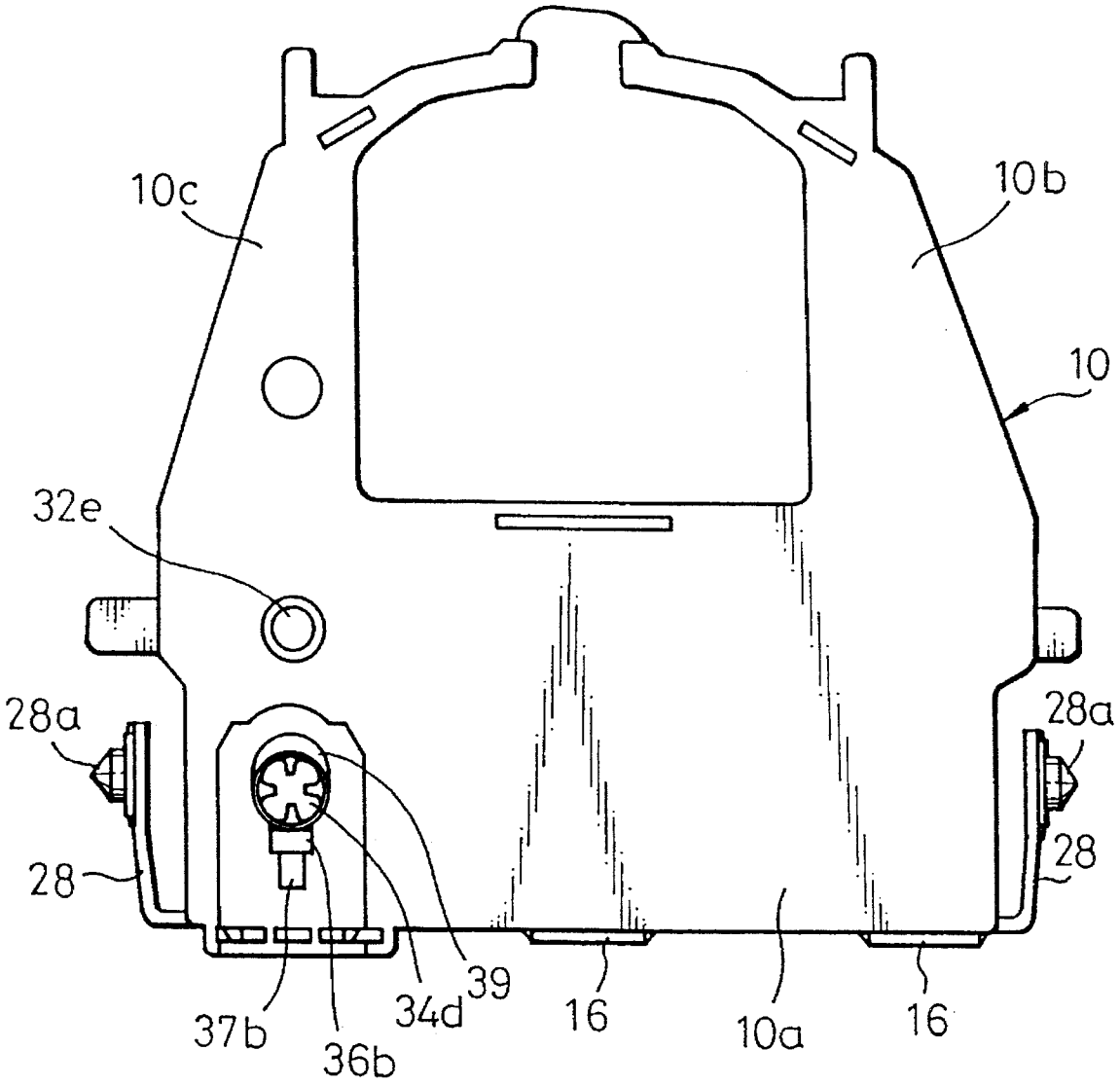
FIG. 7 is a bottom view of the ink ribbon cassette of FIG. 6.

As shown in FIG. 1, to make the endless ink ribbon run, on one side of the rectangular part 10a of the casing 10, that is near the second arm side 10c, a ribbon feed roller 32 and a pressure roller 34 are provided adjacent to each other. As best shown in FIG. 5, the ribbon feed roller 32 is constituted by a shaft element 32a rotatably supported with respect to the bottom portion of the casing 10, a pair of rubber roller elements 32b fixed on the shaft element 32a, and a gear element 32c formed integrally with the shaft element 32a. The top end of the shaft element 32a is projected to the outside through the opening portion formed in the cover 12 as shown in FIG. 5 and FIG. 6, a knurl is formed at that projection part as indicated by reference numeral 32d (FIG. 5), and the bottom end 32e of the shaft element 32a is rotatably attached to a hole formed in the bottom portion of the casing 10 as apparent from FIG. 2, FIG. 5, and FIG. 7. The pressure roller 34 is constituted by a shaft element 34a rotatably supported by a movable frame assembly 36, a pair of rubber roller elements 34b fixed on the shaft element 34a, and a gear element 34c formed integrally with the shaft element 34a. An upward projection 36a and a downward projection 36b are integrally projected from the movable frame assembly 36, the upward projection 36a is slidably accommodated in an elongated hole 37a formed in the cover 12 as apparent from FIG. 5 and FIG. 6, and the downward projection 36b is slidably accommodated in an elongated hole 37b formed in the bottom portion of the casing 10 as shown in FIG. 2, FIG. 6, and FIG. 7, whereby the pressure roller 34 is made slidable in a forward and backward direction with respect to the ribbon feed roller 32. As shown in FIG. 5, a compression coil spring 38 is provided between the rear side wall of the rectangular part 10a of the casing 10 and the movable frame assembly 36, whereby the pressure roller 34 can be held elastically pressed against the ribbon feed roller 32 (FIG. 5, FIG. 6, and FIG. 7), whereby both of the pairs of rubber rollers 32b and 34c can be frictionally engaged with each other and, at the same time, the two gear elements 32c and 34c can be engaged with each other. As shown in FIG. 2 and FIG. 7, the bottom end of the shaft element 34a of the pressure roller 34 is exposed through the opening portion 39 formed in the bottom portion of the casing 10 to the outside thereof, and has an engagement to non-rotatably receive a drive shaft 40 (FIG. 5) provided in the carriage of the printer. In short, the rotational drive force of the drive shaft 40 is transmitted to the ribbon feed roller 32 via the engagement of the gear elements 32c and 34c. Note that, as is apparent from FIG. 2 and FIG. 7, the elongated hole 37b accommodating the downward projection 36b in the movable frame assembly 36 is continuously extended from the opening portion 39 at which the bottom end of the shaft element 34a of the pressure roller 34 is exposed to the outside.

When the drive shaft 40 is driven in a direction indicated by an arrow shown in FIG. 5, the ribbon feed roller 32 and the pressure roller 34 are rotated so as to pull the ink ribbon from the second arm part 10c of the casing 10 to the rectangular part thereof, that is, the ink ribbon storage unit 10a. As apparent from FIG. 1, the ink ribbon feed roller 32 is arranged in such a manner that the ink ribbon 30 is wound around the ribbon feed roller 32 over substantially half the circumference thereof, whereby the ink ribbon 30 can run without slippage with respect to the ribbon feed roller 32. During the rotation of the ribbon feed roller 32, the ink ribbon 30 is sometimes entangled around the ribbon feed roller 32. To eliminate such an entanglement of the ink ribbon 30, a separator 42 is interposed between the rubber rollers 32b of the ribbon feed roller 32, as shown in FIG. 5. Note that the separator 42 is appropriately supported within the casing 10.

A chamber filled with a felt material 44 is provided in a part inside the second arm 10c of the casing 10, and ink is impregnated in the felt material 44. Also, a felt core material 44a is provided in the felt material 44, which felt core material 44a is projected from the above-mentioned chamber and brought into contact with one of the pair of rubber rollers 32b of the ribbon feed roller 32. The ink impregnated into the felt material 44 is supplied through the felt core material 44a to the rubber roller 32b due to capillary action, and that supplied ink is absorbed by the ink ribbon 30. In short, the felt material 44 acts as an ink supply source.

When the service life of the ink ribbon 30 is ended, that is, where the ink ribbon 30 is damaged to such an extent that it cannot perform proper printing, the ink ribbon 30 is replaced by a new one. At this time, the movable frame assembly 36 supporting the pressure roller 34 is moved backward so as to move away from the ribbon feed roller 32 against the spring force of the compression coil spring 38. Such a movement of the movable frame assembly 36 is carried out by nipping the upward projection 36*a* and the downward projection 36*b* thereof between for example a thumb and a forefinger and pulling the same backward. When the movable frame assembly 36 is retracted to the predetermined position relative to the ribbon feed roller 32, the movable frame assembly 36 is locked at that retracted position, that is, at the withdrawn position. In particular, a pair of plate spring elements 36*c* are projected integrally from the two sides of the movable frame assembly 36, and a claw element 36*d* is formed at a free end of each plate spring element 36*c*. When the movable frame assembly 36 is retracted until the claw elements 26*d* of the plate spring elements 36*c* pass through slot holes formed in the rear side wall of the rectangular part 10*a* of the casing 10, each claw element 26*d* is engaged with the corresponding slot hole thereof, whereby the pressure roller 34 is locked at the withdrawn position as shown in FIG. 1 and FIG. 2. When the cover 12 is removed from the casing 10 in this state, a predetermined clearance is given between the ribbon feed roller 32 and the pressure roller 34 (FIG. 1), whereby the replacement of the ink ribbon 30 can be smoothly and easily carried out. After the replacement of the ink ribbon is completed, the cover 12 is attached again to the casing 10, and subsequently the pressure roller 34 is returned from the withdrawn position to the pressing position with respect to the ribbon feed roller 32. This is carried out by touching the claw elements 26*d* of the plate spring elements 36*c*, for example, by the thumb and forefinger and pressing the same so that they approach each other at the rear side wall surface of the rectangular part 10*a* of the casing 10. Namely, when displaced so that the claw elements 26*d* of the plate spring elements 36*c* approach each other, the respective claw elements 26*d* are released from engagement with their corresponding slot holes, and as a result, the movable frame assembly 36*d* is restored to the pressing position with respect to the ribbon feed roller 32 by the compression coil spring 38. Thereafter, the ink ribbon cassette is mounted on the carriage of the printing. At this time, the drive shaft 40 on the carriage is received in the engagement hole 34*d* of the shaft element 34*a* of the pressure roller 34, as shown in FIG. 5.

The user frequently tries to mount the ink ribbon cassette on the carriage of the printer in a state where the pressure roller 34 is locked at the withdrawn position. Nevertheless, according to the present embodiment, in such a case, the mounting of the ink ribbon cassette on the carriage of the printer is reliably obstructed. This is because, when the pressure roller 34 is placed at the withdrawn position, the engagement hole 34*d* formed in the bottom end of the shaft element 34*a* thereof is not in alignment with respect to the drive shaft 40 as apparent from the comparison of FIG. 2 and FIG. 7. In short, as shown in FIG. 5, only when the pressure roller 34 is placed at the pressing position with respect to the ribbon feed roller 32, is the engagement hole 34*d* of the shaft element 34*a* of the pressure roller 34 allowed to receive the drive shaft 40, whereby the mounting of the ink ribbon cassette on the carriage of the printer becomes possible. Thus, according to the present invention, the ink ribbon cannot be in a non-running state after the ink ribbon cassette is mounted on the printer, and therefore the printing impact will not be applied to only one specific portion of the ink ribbon as in the conventional case.

Figure 8:
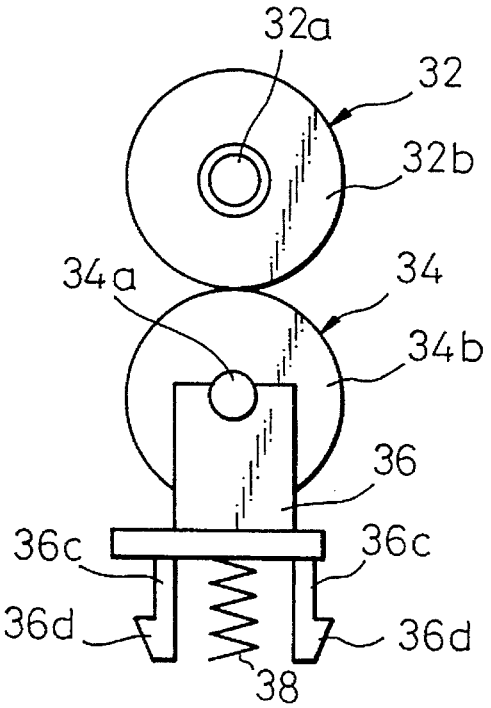
FIG. 8 is a plan view of a modified embodiment of the ribbon feed roller and the pressure roller provided inside the ink ribbon cassette shown in FIG. 1.
Figure 9:
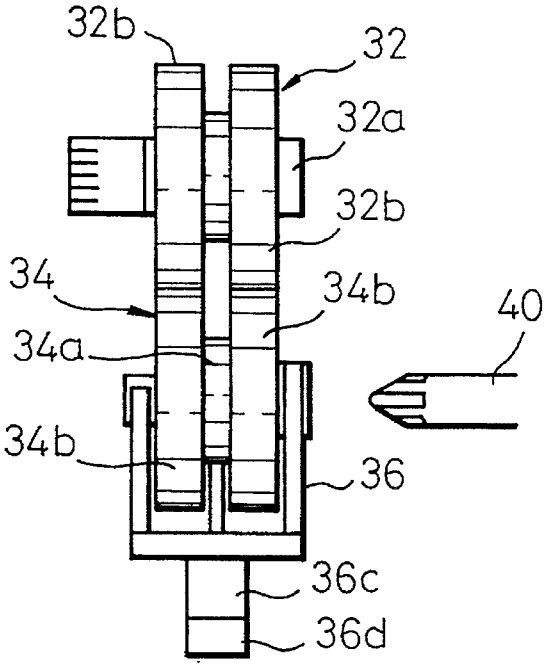
FIG. 9 is a right side view of FIG. 8.

Referring to FIG. 8 and FIG. 9, a modified embodiment of the ribbon feed roller 32 and the pressure roller 34*a* is shown. In this modified embodiment, a pair of rubber roller elements 34*b* of the pressure roller 34 are frictionally engaged with a pair of rubber roller elements 32*b* of the ribbon feed roller 32, and the rotational drive force of the drive shaft 40 is transmitted to the ribbon feed roller 32 by the friction force between them. Note that, in FIG. 8 and FIG. 9, the same reference numerals can be used for constituent elements similar to those in the above-mentioned embodiment.

Figure 10:
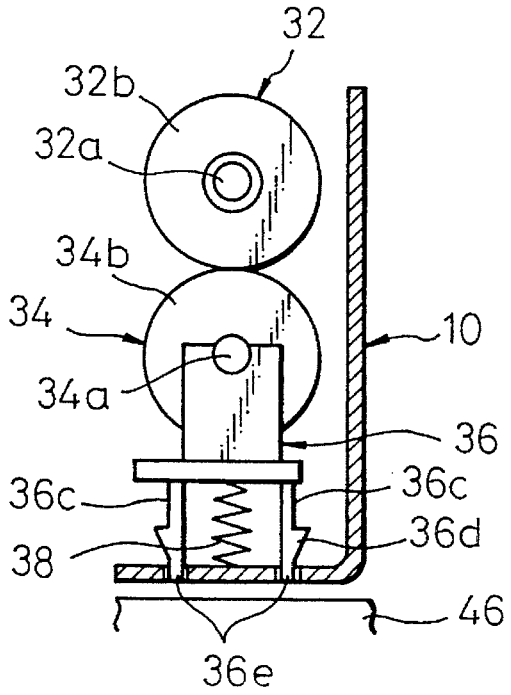
FIG. 10 is a plan view of another modified embodiment of the ribbon feed roller and the pressure roller provided inside the ink ribbon cassette shown in FIG. 1.
Figure 11:
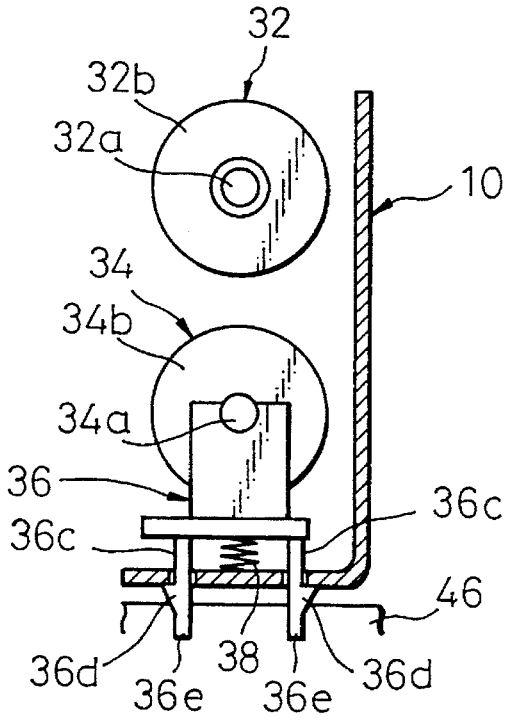
FIG. 11 is a plan view similar to FIG. 10, but showing the pressure roller at the withdrawn position thereof and in a locking state.

Referring to FIG. 10 and FIG. 11, a modified embodiment of the movable frame assembly 36 is shown. In this modified embodiment, an extension portion 36*e* is added to the free end of a pair of plate spring elements 36*c* projected from the movable frame assembly 36. When it is attempted to mount the ink ribbon cassette on the carriage of the printer in a state where the pressure roller 34 is locked at the withdrawn position, the extension portion 36*e* interferes with the structure 46 of the carriage, whereby the mounting of the ink ribbon cassette on the carriage is obstructed. This modified embodiment is advantageous particularly where the ribbon feed roller 32 is constituted as the drive roller, that is, where the ribbon feed roller 32 has an engagement hole for receiving the drive shaft on the carriage of the printer. Note that, also in FIG. 10 and FIG. 11, the same reference numerals can be used for constituent elements similar to those in the above-mentioned embodiment.

Figure 12:
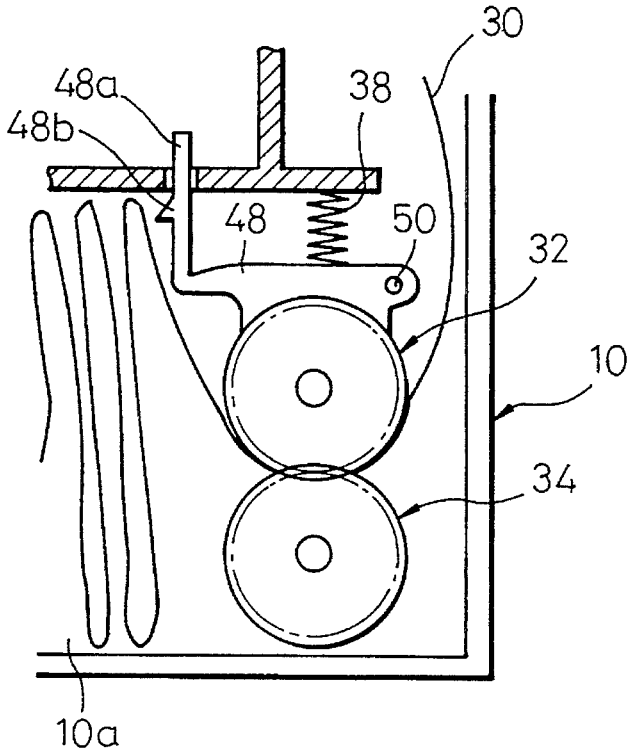
FIG. 12 is a partial plan view of a principal part of yet another embodiment of the ink ribbon cassette according to the present invention.

Referring to FIG. 12, another embodiment according to the present invention is shown. In this embodiment, the ribbon feed roller 32 is rotatably supported by a movable bracket 48, and the pressure roller 34 is rotatably supported at the fixed position relative to the casing 10. The movable bracket 48 can freely pivot around a pivot 50 and in addition is elastically biased toward the pressure roller 34 side by the compression coil spring 38. For this reason, the ribbon feed roller 32 is elastically pressed against the pressure roller 34. Also, the plate spring element 48*a* is integrally extended from the movable bracket 48, and the plate spring element 48*a* is projected to the outside through a hole formed in the front side wall of the rectangular part 10*a* of the casing 10. The claw element 48*b* is formed in the plate spring element 48. When the movable bracket 48 is pivoted in a clockwise direction in FIG. 12, the claw element 48*b* is engaged with the above-mentioned hole, and at this time, the ribbon feed roller 32 is locked at the withdrawn position far away from the pressure roller 34. The bottom end of the shaft element of the ribbon feed roller 32 is exposed from the bottom portion of the casing 10, and a bore which receives the drive shaft provided in the carriage of the printer in a non-rotation state is formed there. Accordingly, when the state where the ribbon feed roller 32 is locked at the withdrawn position is maintained, that ink ribbon cassette cannot be mounted on the carriage of the printer.

Note that, in the present embodiment, a case where the ink ribbon cassette is mounted on the carriage of the printer has been referred to, but it goes without saying that the present invention can be applied also to a so-called installed type ink ribbon cassette which is mounted on the printer per se.

Figure 13:
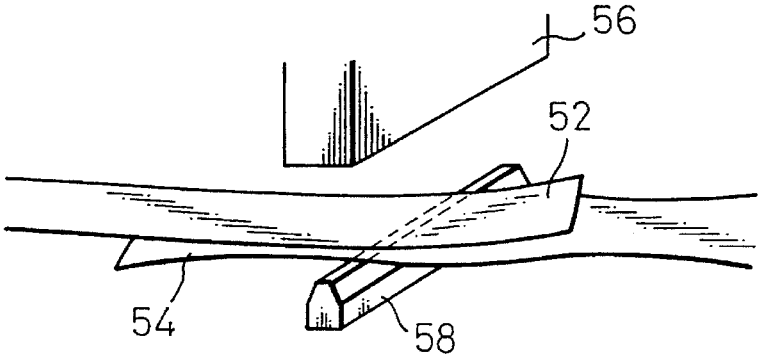
FIG. 13 is a schematic view of a procedure of ultrasonic bonding when the endless ink ribbon is formed from a long strip of an ink ribbon.
Figure 14:
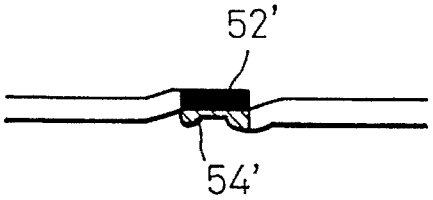
FIG. 14 is a side view of the bonded portion of the endless ink ribbon seen from the width direction thereof.
Figure 15A:
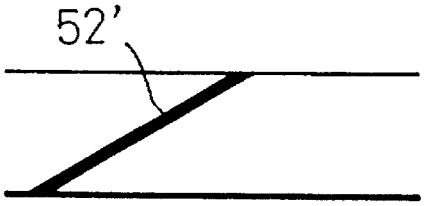
FIG. 15A is a plan view showing one side part of the bounded portion of the endless ink ribbon.
Figure 15B:
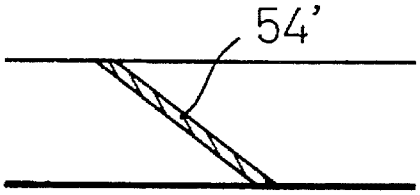
FIG. 15B is a plan view showing the other side part of the bonded portion of the endless ink ribbon.
Figure 16A:
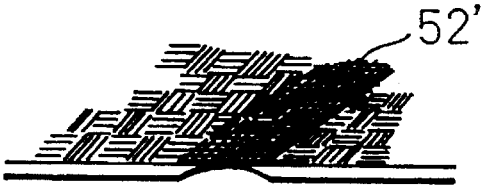
FIG. 16A is a partial perspective view of the one side part of the bonded portion of the endless ink ribbon shown in FIG. 15A.
Figure 16B:
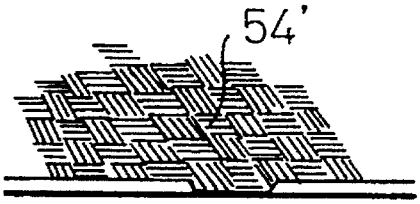
FIG. 16B is a partial perspective view of the other side part of the bonded portion of the endless ink ribbon shown in FIG. 15B.

Referring to FIG. 13, it is illustrated that the endless ink ribbon is formed by bonding the two end portions 52 and 54 of a long length of an ink ribbon by ultrasonic bonding. In this drawing, reference numeral 56 indicates an ultrasonic oscillation horn, and reference numeral 58 indicates a bonding stand. The ink ribbon per se is formed by a fabric made of a nylon fiber. After the two end portions 52 and 54 of the ink ribbon are superimposed on each other and ultrasonically bonded, the excess part on the two sides of that bonded portion is cut and removed. FIG. 14 schematically illustrates such a bonded portion of the endless ink ribbon after the excess part is removed therefrom, which is observed along the width direction of the ink ribbon. In FIG. 14, a one part of the boned portion, indicated by reference numeral 52' and shown as a black solid area, is the side to which the ultrasonic bonding oscillation horn 56 was applied, and is completely molten and formed into a resin. On the other hand, the other part of the bonded portion, indicated by reference numeral 54' and shown as a hatching area, is the side to which the bonding stand 58 was applied, and is brought into a semi-molten state in which the texture remains. Note, the respective parts 52' and 54' of the bonded portion will be referred as a solid part and a semi- solid part, hereinafter. As shown in FIG. 15A and 15B, the bonded portion (52', 54') is inclined with respect to the longitudinal direction of the ink ribbon, and an outer appearance of the bonded portion (52', 54') is shown in FIG. 16A and FIG. 15B. Note that it is well known that ultrasonic energy is moderated by interposing paper, a film, or the like on and below the superimposed end portions of the ink ribbon at the time of the ultrasonic bonding, but even in this case, the bonded portion still has the characteristics mentioned above.

Figure 17:
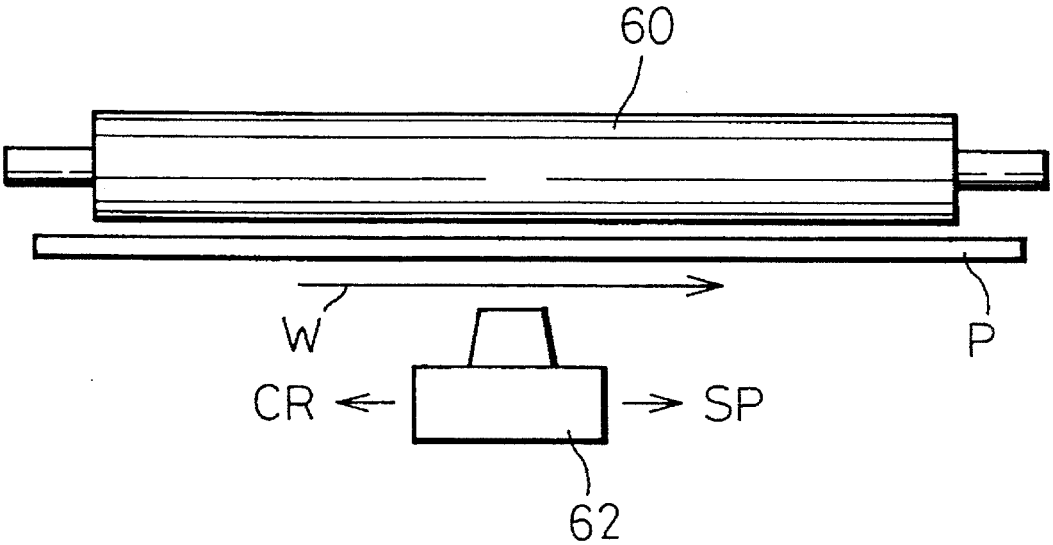
FIG. 17 is a schematic view of the relative relationship between the running direction of the ink ribbon and the movement direction of the printing head.
Figure 18A:
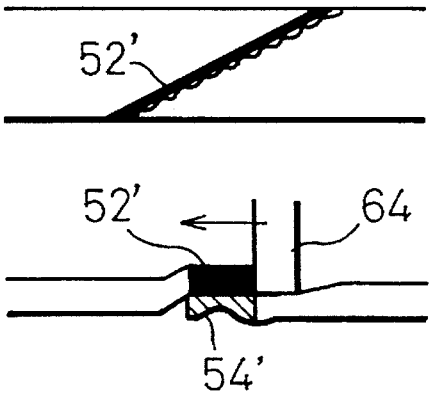
FIG. 18A is a set of a plan view and a side view of the bonded portion of the endless ink ribbon for explaining a passing mode of a printing head of a wire-dot printer with respect to the bonded portion of the endless ink ribbon.
Figure 18B:
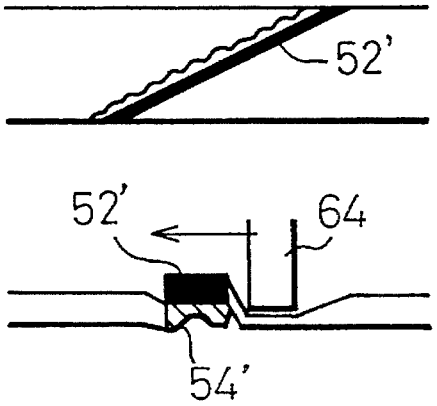
FIG. 18B is another set of plan view and a side view of the bonded portion of the endless ink ribbon for explaining another passing mode of the printing head with respect to the bonded portion of the endless ink ribbon.
Figure 18C:
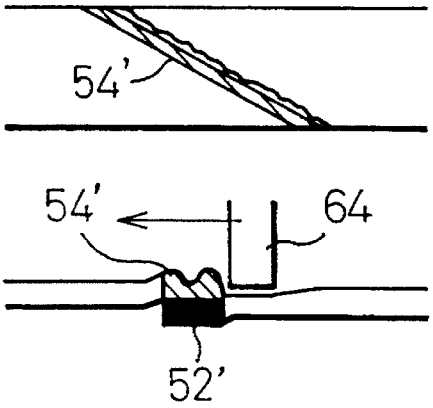
FIG. 18C is yet another set of plan view and a side view of the bonded portion of the endless ink ribbon for explaining another passing mode of the printing head with respect to the bonded portion of the endless ink ribbon.
Figure 18D:
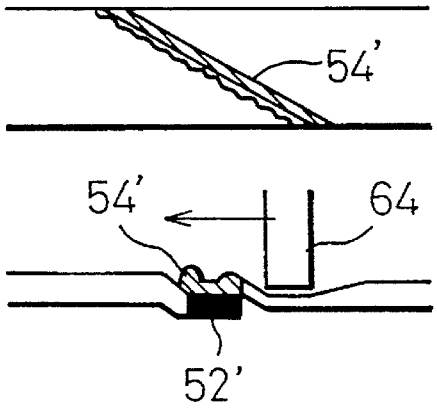
FIG. 18D is yet another set of plan view and a side view of the bonded portion of the endless ink ribbon for explaining another passing mode of the printing head with respect to the bonded portion of the endless ink ribbon.

In FIG. 17, reference numeral 60 indicates the platen of the printer, reference P indicates a recording sheet of paper, an arrow W indicates a running direction of the ink ribbon, and further reference numeral 62 indicates a printing head of the serial wire-dot printer. The printing head 62 will perform the printing operation in both of a CR direction and an SP direction. On the other hand, the printing head 62 can pass over the bonded portion (52', 54') of the ink ribbon in one of two possible modes with respect to each part 52', 54' of the bonded portion depending on the running direction of the ink ribbon and the orientation thereof. In particular, regarding the solid part 52' of the bonded portion of the ink ribbon, there are two passing modes: one passing mode wherein the wires 64 of the printing head 62 face the end face of the solid part 52' and then pass over the solid part 52', as shown in FIG. 18A; and the other passing mode wherein the wires 64 of the printing head 62 pass over the bonded portion from an opposite side of the end face of the solid part 52', as shown in FIG. 18B. Similarly, regarding the semi-solid part 54' of the bonded portion of the ink ribbon, there are two passing mode: one passing mode wherein the wires 64 of the printing head 62 face the end face of the semi-solid part of the bonded portion and then pass over, as shown in FIG. 18C; and the other passing mode wherein the wires 64 of the printing head 62 pass over from an opposite side of the end face of the bonded portion 54', as shown in FIG. 18D. Here, for convenience of explanation, the following is assumed: for the passing modes as shown in FIG. 18A and 18C, it is defined that the printing head 62 passes in the opposed direction with respect to the bonded portion, and for the passing modes as shown in FIG. 18B and 18D, it is defined that the printing head 62 passes in the non-opposed direction with respect to the bonded portion.

In the present invention, a damage test was carried out for each of the four passing modes mentioned above, and an evaluation was carried out for the degree of the damage. The results are as in the following table.

TABLE

| Number of printed letters (Unite: 10,000) | Passing mode bonded portion | | | |
|---|---|---|---|---|
| | FIG. 18A | FIG. 18B | FIG. 18C | FIG. 18D |
| 500 | ◎ | ◎ | ◎ | ◎ |
| 600 | ◎ | ○ | ◎ | ○ |
| 700 | ◎ | ○ | ◎ | ○ |
| 800 | ◎ | ○ | ◎ | ○ |
| 900 | ◎ | ○ | ◎ | ○ |
| 1000 | ◎ | X | ◎ | ○ |
| 1100 | ◎ | X | ◎ | ○ |
| 1200 | ◎ | X | ◎ | ○ |
| 1300 | ◎ | X | ○ | ○ |
| 1400 | ◎ | X | ○ | ○ |
| 1500 | ◎ | X | ○ | ○ |
| 1600 | ◎ | X | ○ | ▲ |
| 1700 | ◎ | X | ○ | ▲ |
| 1800 | ○ | X | ○ | X |
| 1900 | ○ | X | ○ | X |
| 2000 | ○ | X | ○ | X |

An evaluation symbol "◎" in the above-described table indicates "no problem"; an evaluation symbol "○" indicates a state where the ink ribbon fabric becomes thinner in a narrow region adjoining the bonded portion of the ink ribbon; an evaluation symbol "▲" indicates a state where the ink ribbon fabric becomes thinner in a relatively wide region adjoining the bonded portion of the ink ribbon; and an evaluation symbol "x" indicates a state where holes having a size of 0.2 mm or less are generated in a region adjoining the bonded portion of the ink ribbon. Note that, where the evaluation is the "▲" or "x" the ink ribbon is not durable in usage and must be replaced by a new ink ribbon.

It can be seen from the above results that the passing mode as shown in FIG. 18B must be avoided. In the case of the passing mode of FIG. 18B, the wires of the printing head intensively pulls the root portion of the resinified bonded portion and strikes the same, and therefore a boundary between the resinified portion and the fabric portion is apt to be broken. The endless ink ribbon is generally formed into a so-called Mobius strip so as to prolong the service life by making the used position thereof uniform, and the both strip zones of the ink ribbon divided by a longitudinal neutral line thereof are used as a printing zone. In this case, one of two combinations of the four passing modes as shown in FIG. 18A through FIG. 18D occurs. Namely, either of the combination in which the passing modes of FIG. 18A and FIG. 18D alternately appear or a combination in which the passing modes of FIG. 18B and FIG. 18C alternately appear occurs. Of course, to prolong the service life of the ink ribbon, the combination of passing modes of FIG. 18A and FIG. 18D must be selected. Also, where the endless ink ribbon is formed as a simple ring, the passing mode of FIG. 18B should be avoided and a passing mode should be selected from the modes shown in FIG. 18A, FIG. 18C, or FIG. 18D.

As apparent from the above disclosure, according to the first aspect of the present invention, the ink ribbon cassette is reliably obstructed from being mounted on the carriage of the printer while the endless ink ribbon is in a non-running state, and therefore a situation where only a specific position of the ink ribbon is subjected to the printing impact can be avoided.

Also, according to the second aspect of the present invention, the running direction of the ink ribbon and the orientation thereof are defined in accordance with the characteristic of the bonded portion of the endless ink ribbon, whereby it is possible to delay the damage to the ink ribbon at the bonded portion thereof as much as possible.

In short, according to the present invention, it becomes possible to prolong the service life of the endless ink ribbon to the maximum level.

Finally, it will be understood by those skilled in the art that the foregoing description is of preferred embodiments of the present invention, and that various changes and modifications can be made without departing from the spirit and scope thereof.

We claim:

1. An ink ribbon cassette comprising:

an ink ribbon storage means (10*a*) for storing an endless ink ribbon (30);

an ink ribbon passage means extended from a first side of said ink ribbon storage means to a second side thereof;

a ribbon feed roller (32) and a pressure roller (34) provided at the second side of said ink ribbon storage means for making the ink ribbon run from the first side of said ink ribbon storage means to the second side thereof through said ink ribbon passage means, one of said ribbon feed roller and said pressure roller being displaceable between a pressing position at which said one roller is elastically pressed against the other roller and a withdrawn position retracted from said pressing position; and a locking means for releasably locking said one roller at said withdrawn position, wherein either roller of said ribbon feed roller (32) or pressure roller (34) which is made displaceable is constituted as a drive roller, and the other of the same is constituted as a driven roller.

2. An ink ribbon cassette as set forth in claim 1, wherein said drive roller is frictionally engaged with said driven roller at the pressing position thereof, whereby a rotational drive force of said drive roller is transmitted to said driven roller.

3. An ink ribbon cassette as set forth in claim 1, wherein both of said drive roller and said driven roller are provided with gear elements, and when said drive roller is placed at the pressing position thereof, the rotational drive force of said drive roller is transmitted to said driven roller by engagement of said gear elements.

4. An ink ribbon cassette as set forth in claim 1, wherein said drive roller is rotatably supported by a movable support member (36, 48); said movable support member is provided with at least one plate spring element (36*b*, 48*a*) having a claw element (36*d*, 48*b*), said ink ribbon storage means having a side wall with a hole therein; and, wherein said drive roller is placed at the withdrawn position thereof, the claw element of said plate spring element is engaged with said hole formed in said side wall of said ink ribbon storage means, whereby said drive roller is locked at the withdrawn position thereof.

5. An ink ribbon cassette comprising:

an ink ribbon storage means (10*a*) for storing an endless ink ribbon (30);

an ink ribbon passage means extended from a first side of said ink ribbon storage means to a second side thereof;

a ribbon feed roller (32) and a pressure roller (34) provided at the second side of said ink ribbon storage means for making the ink ribbon run from the first side of said ink ribbon storage means to the second side thereof through said ink ribbon passage means, one of said ribbon feed roller and said pressure roller being displaceable between a pressing position at which said one roller is elastically pressed against the other roller and a withdrawn position retracted from said pressing position; and a locking means for releasably locking said one roller at said withdrawn position, wherein either roller of said ribbon feed roller (32) or pressure roller (34) which is made displaceable is constituted as a drive roller; the other of the same is constituted as a driven roller; an shaft element of said drive roller has an engagement hole formed therein for receiving a drive shaft (40) provided in a printer; and, at the time of mounting of the ink ribbon cassette on said printer while said drive roller is placed at the withdrawn position as it is, reception of said drive shaft into the engagement hole of the shaft element of said drive roller is blocked.

6. An ink ribbon cassette as set forth in claim 5, wherein said drive roller is frictionally engaged with said driven roller at the pressing position thereof, whereby a rotational drive force of said drive roller is transmitted to said driven roller.

7. An ink ribbon cassette as set forth in claim 5, wherein both of said drive roller and said driven roller are provided with gear elements, and, when said drive roller is placed at the pressing position thereof, the rotational drive force of said drive roller is transmitted to said driven roller by engagement of said gear elements.

8. An ink ribbon cassette as set forth in claim 5, wherein said drive roller is rotatably supported by a movable support member (36, 48); said movable support member is provided with at least one plate spring element (36*b*, 48*a*) having a claw element (36*d*, 48*b*), said ink ribbon storage means having a side wall with a hole therein; and, when said drive roller is placed at the withdrawn position thereof, the claw element of said plate spring element is engaged with said hole formed in said side wall of said ink ribbon storage means, whereby said drive roller is locked at the withdrawn position thereof.

9. An ink ribbon cassette comprising:

an ink ribbon storage means (10*a*) for storing an endless ink ribbon (30);

an ink ribbon passage means extended from one side of said ink ribbon storage means to the other side thereof;

a ribbon feed roller (32) and a pressure roller (34) provided on the other side of said ink ribbon storage means for making the ink ribbon run from the one side of said ink ribbon storage means to the other side thereof through said ink ribbon passage means, one of said ribbon feed roller and said pressure roller being displaceable between a pressing position at which said one roller is elastically pressed against the other roller and a withdrawal position retracted from said pressing position; and a locking means for releasably locking said one roller at said withdrawal position, wherein either roller of said ribbon feed roller (32) or pressure roller (34) which is made displaceable is constituted as a drive roller; the other of the same is constituted as a driven roller; said drive roller is rotatably supported by a movable support member (36); said movable support member is provided with at least one plate spring element (36*b*) having a claw element (36*d*), said ink ribbon storage means having a side wall with a hole therein; the claw element of said plate spring element is engaged with said hole formed in said side wall of said ink ribbon storage means when said displaceable roller is placed at the withdrawal position thereof, whereby said displaceable roller is locked at the withdrawal position thereof; said plate spring element has an extension portion (36*e*) formed therewith, which is projected from the side wall of the ink ribbon storage means to the outside when said claw element (36*d*) is engaged with said hole; and said extension portion interferes with a structure of a printer at the time of mounting of the ink ribbon cassette on the printer.

10. An arrangement comprising:

an ink ribbon cassette including an ink ribbon storage means (10*a*) for storing an endless ink ribbon (30), an ink ribbon passage means extended from one side of said ink ribbon storage means to the other side thereof, a ribbon feed roller (32) and a pressure roller (34) provided on the other side of said ink ribbon storage means for making the ink ribbon run from the one side of said ink ribbon storage means to the other side thereof through said ink ribbon passage means, one of said ribbon feed roller and said pressure roller being displaceable between a pressing position at which said one roller is elastically pressed against the other roller and a withdrawal position retracted from said pressing position, and a locking means for releasably locking said one roller at said withdrawal position; and a carriage of a printer for detachably mounting said ink ribbon cassette thereon, wherein either roller of said ribbon feed roller (32) or pressure roller (34) which is made displaceable is rotatably supported by a movable support member (36); said movable support member is provided with at least one plate spring element (36*b*) having a claw element (36*d*), said ink ribbon storage means having a side wall with a hole therein; the claw element of said plate spring element is engaged with said hole formed in said side wall of said ink ribbon storage means when said displaceable roller is placed at the withdrawal position thereof, whereby said displaceable roller is locked at the withdrawal position thereof; said plate spring element has an extension portion (36*e*) formed therewith, which is projected from the side wall of the ink ribbon storage means to the outside when said claw element (36*d*) is engaged with said hole; and said extension portion interferes with a part of a structure of said carriage at the time of mounting of the ink ribbon cassette on said carriage.

11. An arrangement as set forth in claim 10, wherein said ribbon feed roller (32) is constituted as a drive roller, and said pressure roller (34) is rotatably supported as a displaceable driven roller by said movable support portion (36).

* * * * *